United States Patent [19]

Turrell et al.

[11] Patent Number: 4,934,908

[45] Date of Patent: Jun. 19, 1990

[54] VACUUM PUMP SYSTEMS

[75] Inventors: David A. Turrell, Burgess Hill; Nigel T. M. Dennis, Crawley, both of England

[73] Assignee: The BOC Group, PLC, Windlesham, England

[21] Appl. No.: 336,163

[22] Filed: Apr. 11, 1989

[30] Foreign Application Priority Data

Apr. 12, 1988 [GB] United Kingdom ..... 8808608

[51] Int. Cl.[5] ..... F04C 25/02

[52] U.S. Cl. ..... 418/9; 418/88; 418/95

[58] Field of Search ..... 418/9, 88, 3, 95, 83; 417/205, 206, 250; 184/6.16

[56] References Cited

U.S. PATENT DOCUMENTS

| | | | |
|---|---|---|---|
| 2,492,075 | 12/1949 | Van Atta | 418/3 X |
| 2,721,694 | 10/1955 | Van Atta | 418/3 X |
| 2,938,664 | 5/1960 | Nöller | 418/88 X |
| 2,940,661 | 6/1960 | Lorenz | 418/88 X |
| 4,504,201 | 3/1985 | Wycliffe | 418/3 |
| 4,662,826 | 5/1987 | Nitta et al. | 417/206 |
| 4,770,609 | 9/1988 | Uchida et al. | 418/9 X |
| 4,797,068 | 1/1989 | Hayakawa et al. | 417/205 X |

FOREIGN PATENT DOCUMENTS 2088957 12/1984 United Kingdom .

*Primary Examiner*—Michael Koczo
*Assistant Examiner*—Douglas J. Makosy
*Attorney, Agent, or Firm*—David M. Rosenblum; Larry R. Cassett

[57] ABSTRACT

A vacuum pump system comprising a first vacuum pump having at least one pumping chamber with port means for communication with an enclosure to be evacuated and having mechanical pumping means mounted on at least one shaft whose bearings and/or gears are contained in a housing and a second vacuum pump having a first pumping chamber with means for communication with the chamber of the first pump and at least one further pumping chamber wherein means are provided for communication between the housing of the first pump and a further pumping chamber of the second pump.

11 Claims, 1 Drawing Sheet

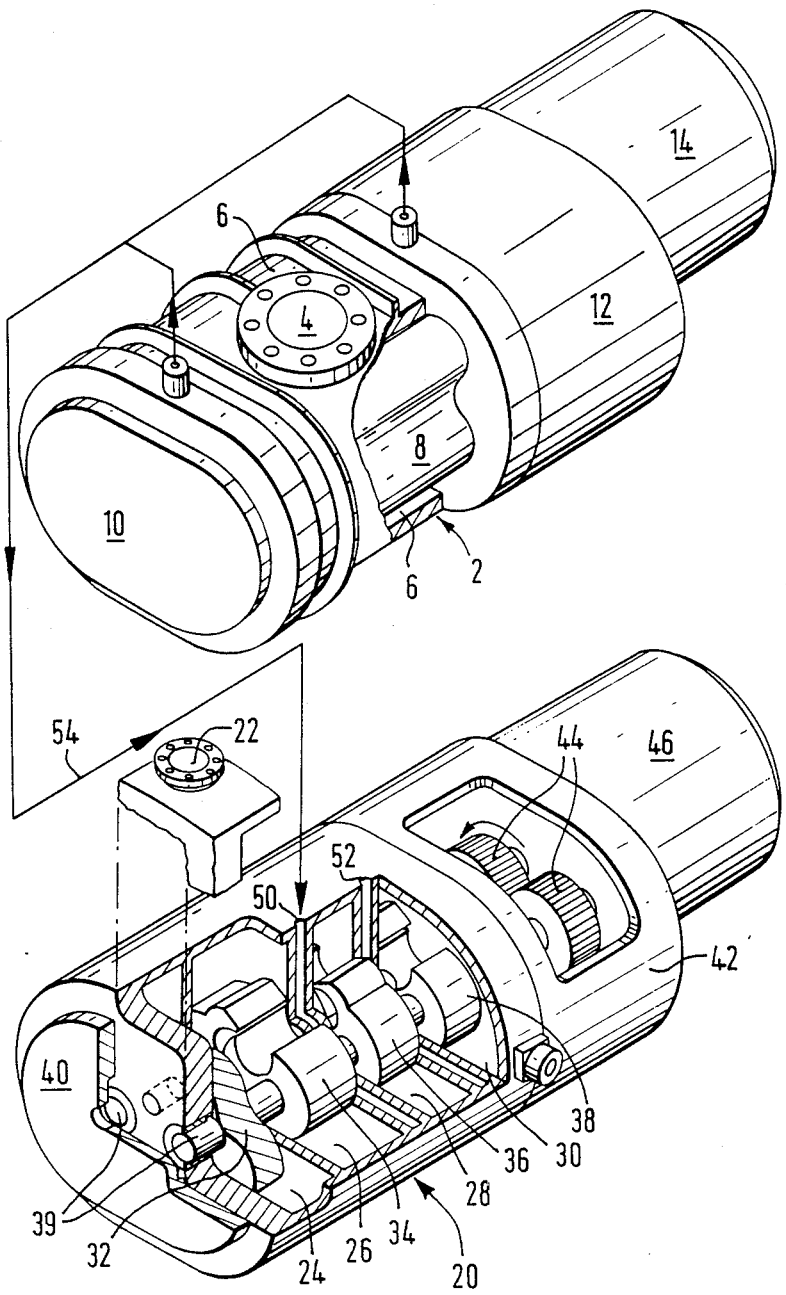
14
6
4
12
8
10
6
2
54
22
44
46
52
50
42
40
38
36
30
28
39
32
24
26
34
20

VACUUM PUMP SYSTEMS

BACKGROUND OF THE INVENTION

This invention relates to vacuum pumping systems and more particularly to a combination of mechanical booster pumps and mechanical backing pumps, suitable for evacuating an enclosure.

A typical oil lubricant free of dry pump is disclosed and described in our UK Patent Specification No. 2,088,957. Such a pump comprises three pumping chambers, two chambers or which, at the outlet end of the pump, can contain intermeshing pairs of rotors of the 'Claw' type with a third chamber at the inlet end of the pump containing intermeshing rotors of the 'Roots' type. A pair of shafts effective to drive the rotor pairs are supported for rotation at either side of the pump by end bearings enclosed in respective sealed housings and are interconnected by meshing gears encased for required synchronisation of rotation in a housing at one end of the pump casing; one of the shafts extends beyond the housing for connection to a prime mover such as an electric motor.

Oil free mechanical pumps of this type provide a high volumetric pumping efficiency and are generally capable of evacuating an enclosure to a pressure of the order of $10^{-2}$ torr.

The absence of lubricant within the pumping chambers of such pumps makes them particularly suitable for applications in which an extremely low level of contamination, particularly from gear train lubricants and end bearing lubricants, is essential and has to be combined with a low ultimate pressure.

To achieve high pumping capacity and pressures below $10^{-2}$ torr, for example pressures of the order of $10^{-3}$ torr, it has been proposed to use such an oil free mechanical vacuum pump in combination with a booster pump of known kind. Such a booster pump which generally also is an oil free pump, interfaces with the enclosure to be evacuated and is backed by an oil free pump of the type described in the above UK patent.

Booster pumps of known kind generally can have a construction similar to that of the oil free mechanical pumps described above. Such pumps typically also comprise at least one chamber with intermeshing rotor pairs mounted upon shafts and supported for rotation at opposite ends of the pump by end bearings enclosed in respective sealed housings. One such housing contains intermeshing gears for producing the required synchronized rotation of the shafts while both housings contain lubricant for the gears and for the shaft bearings.

To ensure rapid evacuation of the pump and enclosure, internal gas passages are provided between each housing and the pumping chamber or chambers of the pump. These passages are convoluted and shielded to ensure that lubricants and impurities from the housings are inhibited from entering the pumping chamber.

One serious disadvantage of such booster pumps arises from the inability completely to stop penetration of lubricant, and in particular lubricant vapour, through these passages and in to the pumping chambers of the pump. This applies in particular to lubricants such as perfluoropolyether (PFPE) lubricants. Such lubricants could ultimately reach the enclosure being pumped by a combination of back diffusion and transfer from rotor to rotor and thereby considerably increase the level of contamination in the enclosure. In many cases, particularly for applications requiring a clean environment, the amount of contamination so carried over into the pumped enclosure can reach unacceptable levels.

The present invention is concerned with a reduction in the amount of contamination in the enclosure being pumped arising in particular from lubricants and other impurities present in the bearing housings of such pumps.

SUMMARY OF THE INVENTION

In accordance with the present invention, there is provided a vacuum pump system comprising a first vacuum pump having at least one pumping chamber with port means for communication with an enclosure to be evacuated and having mechanical pumping means mounted on at least one shaft whose bearings and/or gears are contained in a housing, and a second vacuum pump having a first pumping chamber with means for communication with a (or the) chamber of the first pump and at least one further pumping chamber, wherein means are provided for communication between the housing of the first pump and a further pumping chamber of the second pump.

In such a system, the "first" vacuum pump can generally be regarded as a booster pump and the "second" vacuum pump can generally be regarded as a backing pump in relation to the introduction to this specification.

Preferably, the mechanical pumping means of the first vacuum pump comprises intermeshing rotors mounted on shafts within the chamber.

Suitably, the first pump is a single stage oil free mechanical pump having intermeshing rotors of the Roots type; in addition, the backing pump is preferably an oil free mechanical vacuum pump.

To prevent the presence of oil or lubricants entering the pumping chamber(s), the housing of the first pump in particular should be substantially sealed from the pumping chamber of chambers. In preferred embodiments, the first pump has only one pumping chamber.

With regard to the second pump, it is preferred that each pumping chamber contains intermeshing pairs of rotors.

In preferrred embodiments, the second pumping has a first pumping chamber and two, most preferably three, further pumping chambers. In such embodiments, the first pumping chamber preferably contains pairs of rotors of the "Roots" type and the two or three further pumping chambers each contain intermeshing pairs of rotors of the "Claw" type.

Suitably, the second pump is arranged to have 'Claw' type rotors which in adjacent pumping chambers, are mounted in opposite angular directions to simplify interstage porting in the manner disclosed and claimed in our United Kingdom Patent No. 2,088,957.

Conveniently, the system of the invention includes, when the bearings and/or gears of the mechanical pumping means of the first pump are contained in more than one housing, means for each housing to be in communication with a further pumping chamber of the second pump.

BRIEF DESCRIPTION OF THE DRAWING

To illustrate the invention, reference will now be made to the following exemplified embodiment of the invention with reference to the accompanying schematic drawing which is a perspective view of a vacuum pump system of the invention.

DETAILED DESCRIPTION

Referring to the drawing, the pump system shown in the drawing comprises a first pump in the from of an oil free mechanical booster pump, indicated generally at 2, having a flanged inlet port 4 adapted to communicate with an enclosure (not shown) to be evacuated. Inlet port 4 also communicates with a pumping chamber 6 having a single pair of intermeshing rotors 8 of the 'Roots' type capable of providing a compression ratio of the order of 30. The pump 2 is generally capable, when in combination with a second pump in accordance with the system of the invention of providing a relatively clean vacuum within the enclosure of the order of $10^{-3}$ torr.

The intermeshing rotors 8 of the pump 2 are carried upon shafts (not shown); the pair of shafts are conventionally supported for rotation at one end of the pump by lubricated bearings which are enclosed in a housing 10. Shaft sealing which is also waithin the housing 10 is adapted effectively to contain the lubricant used together with contaminants derived from interaction of the lubricant, and bearings as well as other contaminants arising from the breakdown of the lubricant with prolonged use and to prevent them from reaching the pumping chamber 6.

At the opposite end of the booster pump 2, a relatively larger housing 12 encloses similar bearings and shaft sealing for the other ends of the rotors' shafts together with intermeshing gears used to drive the shafts in the selected angular directions. In housing 12 one of the rotor shafts engages, through a coupling, with the shaft of an electric motor prime mover 14 for the pump 2. Housing 12 also encloses sealing means for the motor shaft against ingress of atmospheric air into the housing 12 which, in normal operation, is under vacuum.

Backing for the booster pump 2 is provided by a second pump in the form of an oil free mechanical pump indicated generally at 20. The pump 20 has a flanged inlet port 22 which is adapted to communicate with an exhaust port (not shown) of the pump 2 and to communicate with the first pumping chamber 24 of the pump 20.

The pump 20, which is substantially of the form disclosed and described in our UK patent specification No. 2,088,957, has four oil free pumping chambers 24, 26, 28 and 30. The first chamber 24 contains an intermeshing pair of rotors 32 of the 'Roots' type while further chambers 26, 28 and 30 contain intermeshing pairs of rotors 34, 36 and 38 respectively of the 'Claw' type.

All the pairs of the Claw type rotors in pump 20 are, as in the pump disclosed and described in our UK patent specification No. 2,088,957, mounted upon shafts in reverse orientation, that is to say in opposite angular directions to optimise volumetric pumping efficiency and in particular to simplify the interstage porting and gas transfer efficiency internally of the pump.

Similarly to the arrangement of pump 2, the rotors shafts 39 of pump 20 are supported at one end of the pump 20 by bearings and sealed with shaft seals enclosed within a sealed housing 40; a sealed housing 42 at the opposite end of the pump 20, encloses bearings and shaft seals for the other ends of the shafts as well as intermeshing gears 44 for driving the shafts in the seleted angular direction by an electric motor 46.

Also as in the pump disclosed and claimed in the UK patent specification referred to above, the chambers of the pump 20 are interconnected by ports provided in the walls separating the pumping chambers in which the rotors are disposed.

To reduce the level of contamination in the chamber 6 and/or enclosure being evacuated in consequence, for example, of the transfer of contaminants from within enclosures 10 and 12 of pump 2, the internal gas transfer ports in the pumping chamber walls between stages 26 and 28 of pump 20 are adapted by conventional means to extend to external ports 50 and 52 respectively at the outer housing of the pump. The port 50 accordingly is an inlet port to the penultimate stage 28 of the pump 20 while the port 52 is an inlet port to the ultimate stage 30 of the pump.

In a preferred embodiment of the invention, the port 52 is suitably blanked off. Inlet port 50 is however connected by any suitable high vacuum conduit 54 to the bearing housings 10 and 12 of the pump 2.

In operation of the pumps 2 and 20, vapour evolved, for example from lubricants present in the housings 10 and 12 will be drawn into the pumping chamber 28 of the pump 20 and subsequently into stage 30 of the pump 20 and finally to the pump exhaust. In this way, the lubricant and other impurities will be inhibited from entering the pump chamber 6 as well as the enclosure being evacuated by pump 2, whether by diffusion and/or rotor transfer, and will reduce the level of such impurity in the pump 2 and the evacuated enclosure.

By entering the penultimate chamber 28 of pump 20, such lubricant or impurity will not appreciably affect the degree of vacuum torr which can be provided by the combination of the pump 2 and the pump 20 and can generally improve the overall pumping cleanliness of the pumping arrangement. It has been found that by the use of the present invention, impurities drawn from housings 10 and 12 of pump 2 can improve the level of impurity detected in the enclosure being pumped by a factor of 30.

In an alternative embodiemt of the present invention, the conduit 54 may be connected to the pumping chamber 30 of the pump 20 by way of inlet port 52, with inlet port 50 blanked off. Equally, although not shown in the drawing, the conduit 54 may be connected to the pumping chamber 26 by means of a suitable inlet port and blanking off ports 50 and 52.

It will be appreciated that while the invention has been described with specific reference to an oil free booster pump backed by an oil free mechanical vacuum pump, decreased levels of contamination in an enclosure being evacuated can nonetheless be obtained if the backing pump is not an oil free mechanical vacuum pump.

It will equally be appreciated that while both housings 10 and 12 of the booster pumps 2 of the present invention are pumped by pump 20, some reduction of contamination, possibly to an acceptable level, can be provided by pumping one such housing only.

We claim:

1. A vacuum pump system comprising a first vacuum pump having at least one pumping chamber with port means for communication with an enclosure to be evacuated and having mechanical pumping means mounted on at least one shaft whose bearings and/or gears are contained in housing, and a second vacuum pump having a first pumping chamber with means for communication with a (or the) chamber of the first pump and at least one further pumping chamber, wherein means are provided for communication between the housing of the first pump and a further pumping chamber of the second pump.

2. A system according to claim 1 in which the mechanical pumping means of the first vacuum pump comprises intermeshing rotors mounted on shafts within the chamber.

3. A system according to claim 2 in which the first pump is a single stage oil free mechanical pump having intermeshing rotors of the "Roots" type.

4. A system according to claim 1 in which the second pump is an oil free mechanical vacuum pump.

5. A system according to claim 1 in which the housing of the first pump is substantially sealed from the pumping chamber of chambers.

6. A system according to claim 1 in which the first pump has one pumping chamber.

7. A system according to claim 1 in which each pumping chamber of the second pump contains intermeshing pairs of rotors.

8. A system according to claim 1 in which the second pump has a first pumping chamber and three further pumping chambers.

9. A system according to claim 8 in which the first pumping chamber contains intermeshing pairs of rotors of the "Roots" type and the further pumping chambers each contain intermeshing pairs of rotors of the "Claw" type.

10. A system according to claim 8 in which the intermeshing pairs of rotors of the "Claw" type are mounted in opposite angular directions in adjacent pumping chambers.

11. A system according to claim 1 in which, when the bearings and/or gears of the mechanical pumping means of the frist pump are contained in more than one housing, means are provided for each housing to be in communication with a further pumping chamber of the second pump.

* * * * *

UNITED STATES PATENT AND TRADEMARK OFFICE

CERTIFICATE OF CORRECTION

PATENT NO. : 4,934,908

DATED : June 19, 1990

INVENTOR(S) : David A. Turrell and Nigel T.M. Dennis

It is certified that error appears in the above-identified patent and that said Letters Patent is hereby corrected as shown below:

Column 4, line 64: after "in" insert --a--

Column 5, line 14: delete "of" and substitute --or--

Column 6, line 15: delete "frist" and substitute --first--

Signed and Sealed this

Fifth Day of October, 1993

*Attest:*

*Attesting Officer*

BRUCE LEHMAN

*Commissioner of Patents and Trademarks*